US010577060B2

(12) United States Patent
Hawes

(10) Patent No.: US 10,577,060 B2
(45) Date of Patent: Mar. 3, 2020

(54) ADJUSTABLE FIN ASSEMBLY FOR WATERCRAFT

(71) Applicant: Larry Hawes, Vista, CA (US)

(72) Inventor: Larry Hawes, Vista, CA (US)

( * ) Notice: Subject to any disclaimer, the term of this patent is extended or adjusted under 35 U.S.C. 154(b) by 0 days.

(21) Appl. No.: 16/030,270

(22) Filed: Jul. 9, 2018

(65) Prior Publication Data

US 2019/0016421 A1 Jan. 17, 2019

Related U.S. Application Data

(60) Provisional application No. 62/533,583, filed on Jul. 17, 2017.

(51) Int. Cl.

| | |
|---|---|
| ***B63B 1/00*** | (2006.01) |
| ***B63B 35/00*** | (2020.01) |
| ***B63B 35/79*** | (2006.01) |
| ***B63B 9/06*** | (2006.01) |

(52) U.S. Cl.

CPC ..... *B63B 35/793* (2013.01); *B63B 9/06* (2013.01)

(58) Field of Classification Search

CPC ..... B63B 1/24; B63B 1/242; B63B 2001/24; B63B 35/7926; B63B 35/793; B63B 39/06; B63B 2039/06

USPC ..... 114/39.15, 127, 278, 280; 441/79

See application file for complete search history.

(56) References Cited

U.S. PATENT DOCUMENTS

| | | | | |
|---|---|---|---|---|
| 3,564,632 | A | 2/1971 | Bahne, Jr. | |
| 4,701,144 | A | 10/1987 | DeWitt, III | |
| 4,846,745 | A | 7/1989 | Lobe | |
| 5,215,488 | A | 6/1993 | Bailey | |
| 6,763,689 | B1 * | 7/2004 | Thomas | E05B 73/007 441/74 |
| 6,837,763 | B1 | 1/2005 | Masteller | |
| 7,117,699 | B2 * | 10/2006 | Bistline | B63B 35/793 70/58 |
| 8,845,374 | B2 | 9/2014 | Higgins | |
| 2015/0166152 | A1 | 6/2015 | Ganguli | |

* cited by examiner

*Primary Examiner* — Daniel V Venne

(74) *Attorney, Agent, or Firm* — Steins & Associates, P.C.

(57) ABSTRACT

An Adjustable Fin Assembly for Watercraft. The modular assembly should be design to be incorporated into a surfboard or other watercraft during fabrication of the craft. Each fin assembly is designed to allow for the watercraft user or fabricator to attach a conventional fin element to it. The fin assembly enables the user to adjust the fin position longitudinally as well as laterally relative to the watercraft. The housings each include a set screw or other component that can be loosened and tightened by the user in order to reposition the fin and then fix it in the new position. The conventional fin attaches to a sliding plate that is housed within a housing, wherein the movement of the sliding plate relative to the housing is prevented by engagement with the set screw.

14 Claims, 7 Drawing Sheets

1

1

2

A - A

B - B

ADJUSTABLE FIN ASSEMBLY FOR WATERCRAFT

This application is filed within one year of, and claims priority to Provisional Application Ser. No. 62/533,583, filed Jul. 17, 2017.

BACKGROUND OF THE INVENTION

1. Field of the Invention

This invention relates generally to watercraft and, more specifically, to an Adjustable Fin Assembly for Watercraft.

2. Description of Related Art

Surfboards, sailboards and other watercraft usually include one or more "fins" extending downwardly from the bottom surface of the board (see e.g. FIG. 5). These fins are extremely important to the performance characteristics of the board in the water, for both control of the board, as well as its responsiveness. In fact, it has been said that fin positioning and profile have as much or more effect on the performance of the board than does even the size and shape of the board itself.

Recognizing the importance of the fin to the performance of the board, there have been a number of innovations related to the positioning of the fin as it extends from the bottom of the watercraft. One example of this type of device is depicted in FIG. 1. FIG. 1 is an exploded view of a Sailboard Fin Retaining Member of U.S. Pat. No. 4,846,745 issued to Lobe. In the Lobe device 10, a fin 4 attaches to a slot 6 formed in the bottom of the board via a mechanism that both allows the user to selectively position the fin 4, as well as allowing it to pivot around pivot pin 3 in the event that the fin 4 strikes an obstruction while it is in use (via breakaway of either the bolt 2 or the plate 1). The fin 4 can be slid along the length of the slot 6 and then fixed in place by tightening the bolt 2.

Another example of an adjustable fin is depicted in FIG. 2. FIG. 2 is an exploded perspective view of the Adjustable Fin Positioning System of U.S. Pat. No. 6,837,763 issued to Masteller. The Masteller system 20 has a T-shaped slot 30 formed within the fin block 28 (which is embedded in a surfboard, for example). The conventional fin 22 attaches to one or more positioning members 24 (such as one per fin peg as shown here). The positioning members 24 are inserted into the slot 30 (through an opening at one end of the slot 30), and then the fin 22 is attached to them. The fin 22 and members 24 are then slid into the desired position along the slot 30, and a securing bolt 32 is driven through the top of the Board in order to fix the fin 22 in place. If the use wished to move the fin 22, he or she would simply loosen the bolt 32, reposition the fin 22 (and members 24), and then re-tighten the bolt 32.

While both the Lobe and the Masteller devices provide an advancement over the conventional fixed-location fin mounting systems, they fall short in one critical way—lateral positioning. These two systems permit the user to move the fin fore-and-aft along the axis of the watercraft, but neither one of them permits the user to adjust the fin's position laterally (side-to-side). As discussed above, the position of the fin is extremely important to the performance of the Board, and so what is needed is a system and assembly that allows the user to not only position the fin longitudinally, but also laterally.

SUMMARY OF THE INVENTION

In light of the aforementioned problems associated with the prior devices and systems, it is an object of the present invention to provide an Adjustable Fin Assembly for Watercraft. The modular assembly should be design to be incorporated into a surfboard or other watercraft during fabrication of the craft. Each fin assembly should be designed to allow for the watercraft user or fabricator to attach a conventional fin element to it. The fin assembly should enable the user to adjust the fin position longitudinally as well as laterally relative to the watercraft. The housings should include a set screw or other component that can be loosened and tightened by the user in order to reposition the fin and then fix it in the new position. In its preferred form, the conventional fin should attach to a sliding plate that is housed within a housing, wherein the movement of the sliding plate relative to the housing is prevented by engagement with the set screw.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an Adjustable Fin Assembly for Watercraft.

Figure 3:
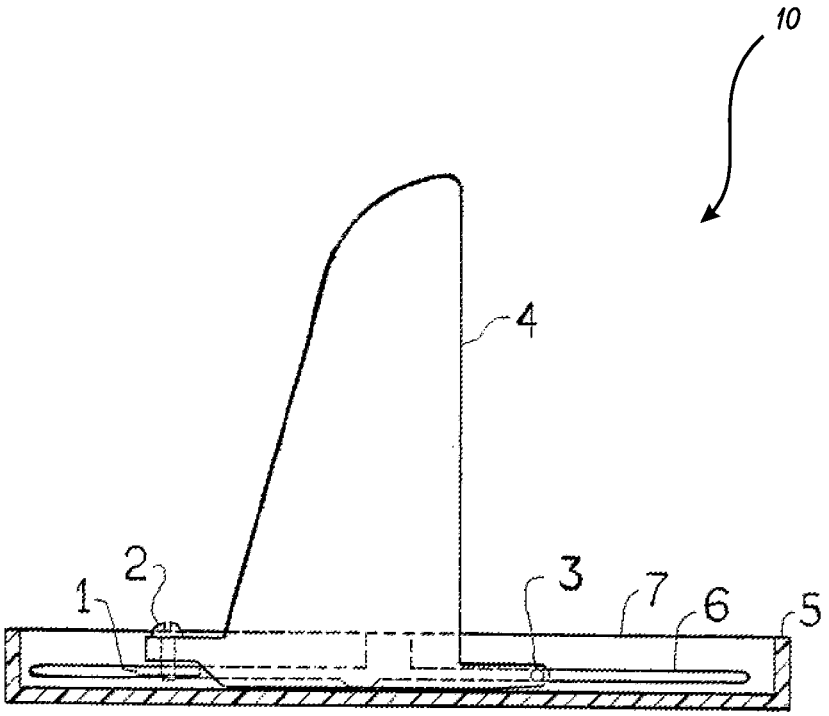
FIG. 3 is a perspective view of a preferred embodiment of the fin mounting assembly of the present invention.
Figure 3:
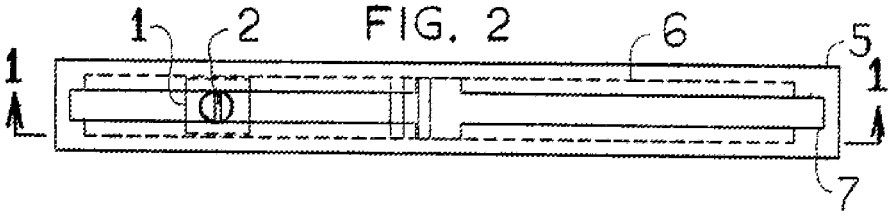

The present invention can best be understood by initial consideration of FIG. 3.[1] FIG. 3 is a perspective view of a preferred embodiment of the fin mounting assembly 30 of the present invention. The housing 33 (which contains the components of the assembly 30) is designed to be embedded into the foam substrate of the surfboard as it is being constructed. After the gel coat has been applied to the surfboard, the cap 37 will be exposed to the outer surface of the surfboard, and may be configured to be removable. This allows the user to remove the cap 37 when needed, such as to replace a fin due either to breakage or to change the fin design for performance reasons, as well as to replace internal components of the assembly 30.

[1] As used throughout this disclosure, element numbers enclosed in square brackets [ ] indicates that the referenced element is not shown in the instant drawing figure, but rather is displayed elsewhere in another drawing figure.

In this version, the housing 33 is generally flat, rectangular shape. In other non-depicted versions, the housing 33 may be narrower in width, depending upon the particular installation needs. In any case, the depth of the housing is expected to be less than the typical thickness of the conventional surfboard, however, when utilized for other watercraft (and where additional strength may be desired), the housing 33 thickness may be greater.

The cover 37 for the housing 33 has one or more openings in it that are provided to expose the slider plate 34 that is held within the housing 33. The slider plate 34 is configured with one or more fin pin sockets 36. The fin pin sockets 36 are available in a variety of configurations in order to allow virtually any off-the-shelf fin to be attached to it. This includes one-pin fins, two-pin fins, and even fins that mount with an elongated rail-shaped pin.

The novelty of the present invention lies with the design and operation of the slider plate 34A. The slider plate 34A is cooperatively configured with the interior volume of the housing 33 so that the slider plate 34A can move laterally and longitudinally (in any two co-planar axes) until it is fixed in its place by tightening the set screws 40. The set screws 40 are designed so that they can be repeatedly loosened and re-tightened. These set screws 40 can double as the screws that attach the top cap 37 to the housing 33. This allows the user to easily change the location of the slider plate 34A as it relates to the housing 33. Since the housing 33 is embedded within the watercraft hull, this means that moving the slider plate 34A will move the position of the fin pin sockets 36 relative to the watercraft hull. As should be apparent, this will also result in the fin (that is attached to the slider plate 34A) to be movable relative to the watercraft hull. Since the slider plate 34A can slide in two co-planar directions, the fin(s) position will also be positionable in that plane.

Figure 4:
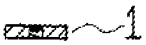
FIG. 4 is a perspective view of an alternate slider plate for use with the assembly of FIG. 3.
Figure 1:
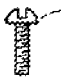
FIG. 1 PRIOR ART
FIG. 1 is an exploded view of the Sailboard Fin Retaining Member of Lobe.
Figure 2:
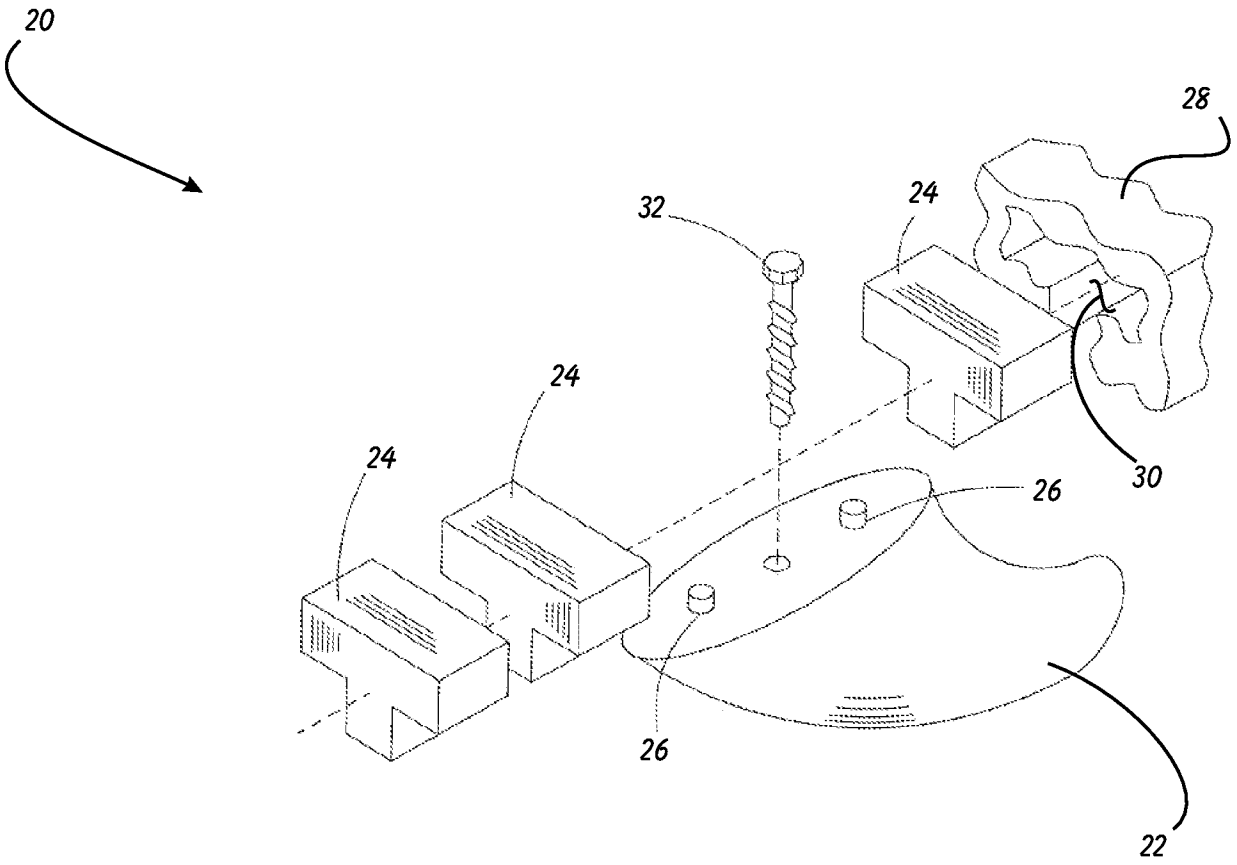
FIG. 2 PRIOR ART
FIG. 2 is an exploded perspective view of the Adjustable Fin Positioning System of Masteller.
Figure 3:
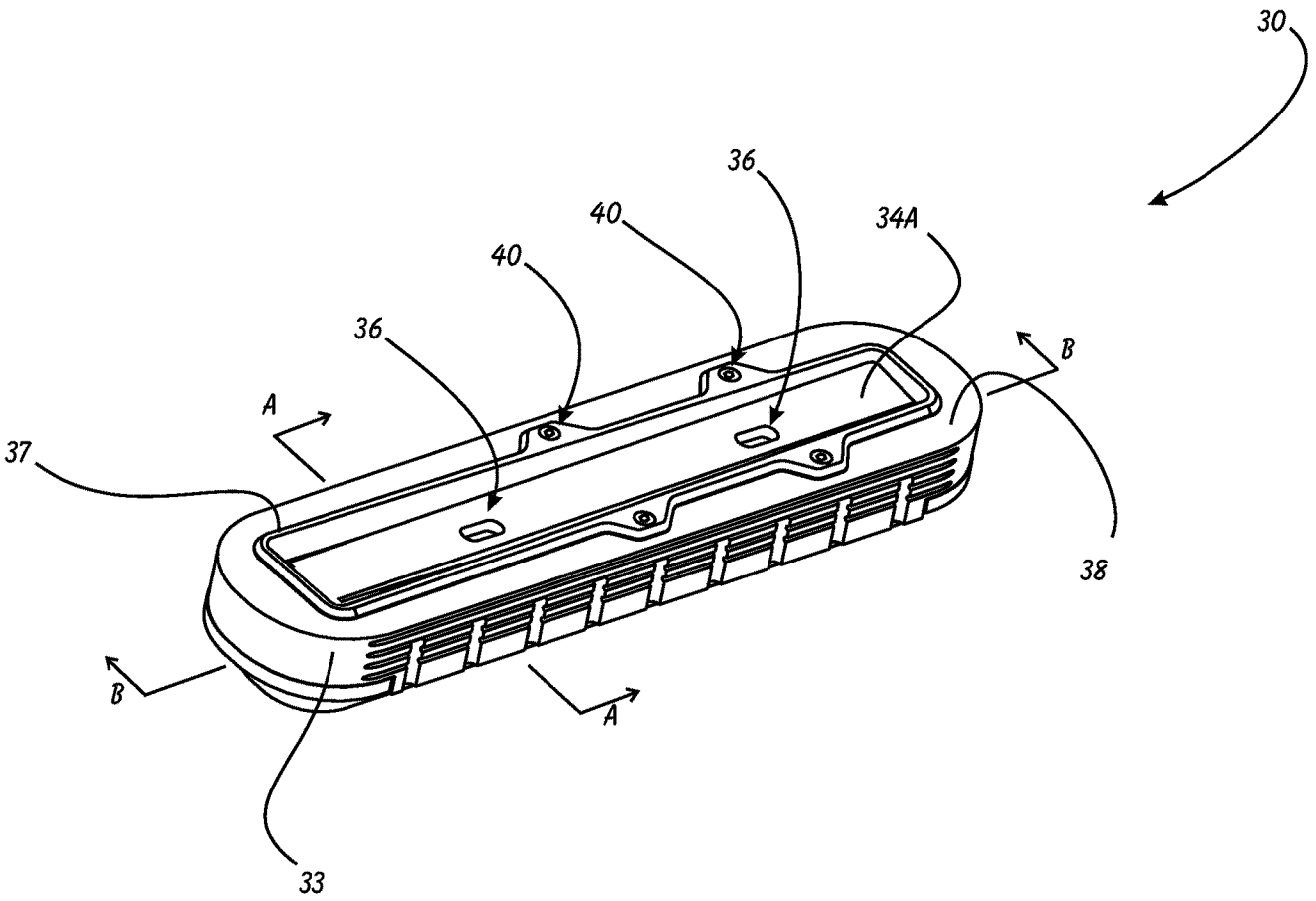
Figure 4:
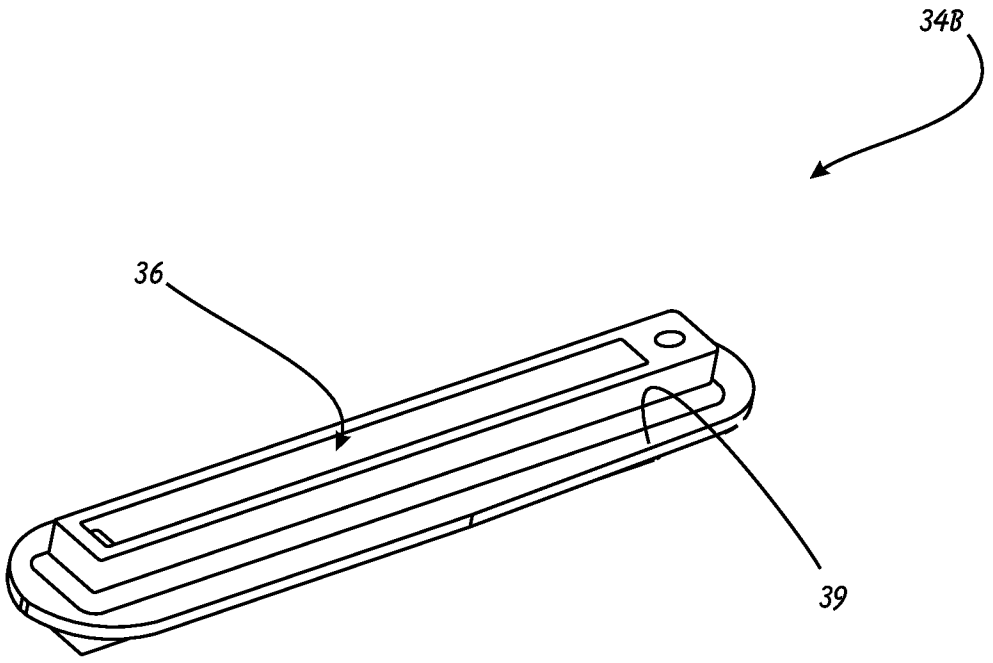

FIG. 4 depicts a second embodiment of the slider plate 34B. Slider plate [34A] is configured with a pair of fin pin sockets 36. In the slider plate 34B depicted here, there is only a single elongate pin socket 36. The aperture shown adjacent to the socket 36 is designed to accept a threaded fastener therein in order to attach the single-pin fin element to the slider plate 34B.

This view also reveals the securing fin 39. The securing fin 39 is captured within the housing [33] when the assembly [30] is fully assembled. The securing fin 39 is wider and longer than the opening in the top surface [38] of the housing [33]. Once the slider plate 34B is positioned as desired, the user tightens down the set screws [40], which will extend until they press against the securing fin 39, such that the slider plate 34B is held in place.

Figure 5:
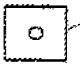
FIGS. 5A and 5B are cutaway end and side views, respectfully of the assembly of FIG. 3.
Figure 5A:
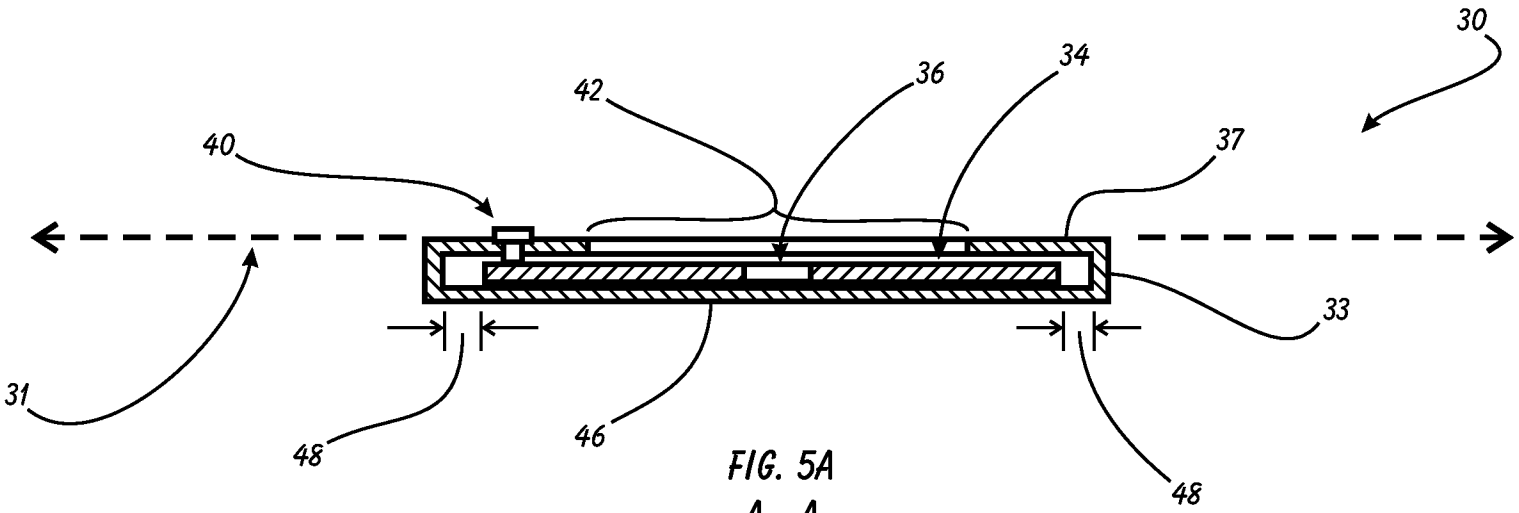
Figure 5B:
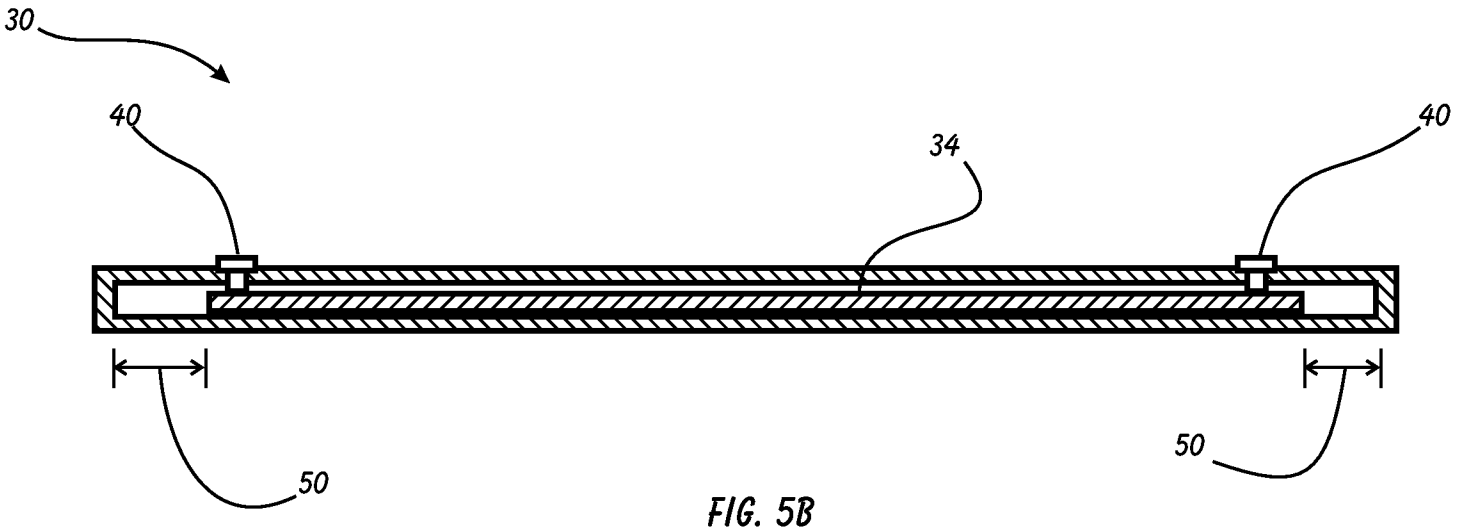

If we now turn to FIGS. 5A and 5B, we can examine the internal geometry of the assembly 30. FIGS. 5A and 5B are cutaway end and side views, respectfully of the assembly 30 of FIG. 3. As shown, the housing 33 defines an interior volume that is larger than the slider plate 34. The side gaps 48 and end gaps 50 between the outer edges of the slider plate 34 and the interior of the walls of the housing 33 provide the space necessary to allow the slider plate 34 to move in any of these directions. As the slider plate 34 is moved, the position of the fin pin socket(s) 36 will move relative to the fin opening 42 in the top wall 37 (housing cover). The top wall 37 defines a spacial plane 31 in parallel to which the slider plate 34 can slidingly move. Once the slider plate 34 has been positioned as desired, the set screws 40 are tightened until the slider plate 34 is pinched between the set screws 40 and the bottom wall 46 of the housing 33. The ultimate functionality provided by the flexibility in movement of the slider plate 34 is shown in FIG. 6.

Figure 6:
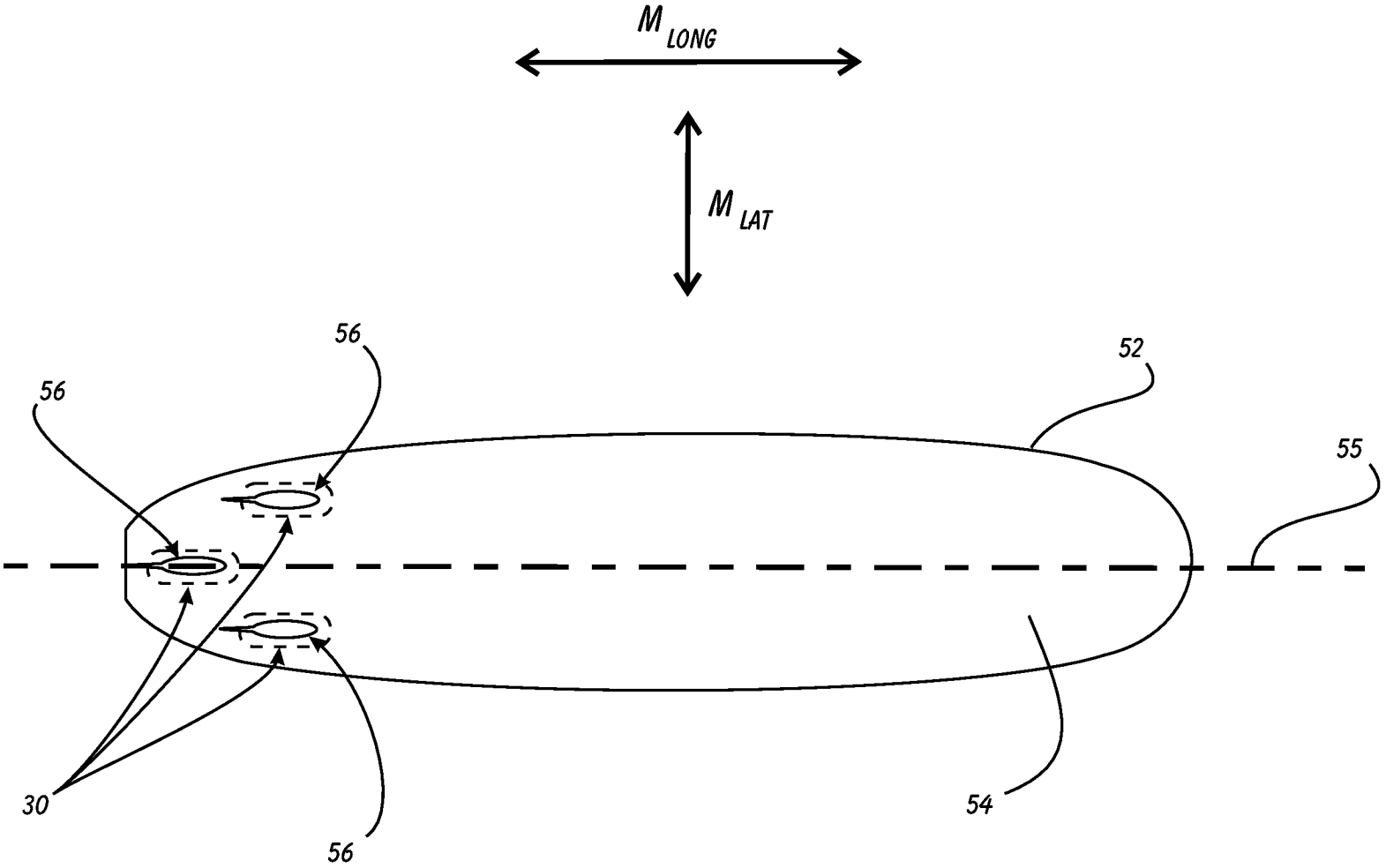
FIG. 6 is a bottom view of a conventional surfboard having assemblies of FIG. 3 incorporated therein.

FIG. 6 is a bottom view of a conventional surfboard 52 having assemblies 30 of FIG. 3 embedded therein. The three assemblies 30 are shown here embedded within the core of the surfboard 52 such that their upper walls [37] are flush with the bottom surface 54 of the surfboard near its tail end. Each assembly 30 has a fin element 56 extending from it (towards the viewer in this depiction). As should be apparent, as the slider plate [34] is moved, it permits each of the fin elements 56 to be moved longitudinally ($M_{LONG}$) as well as laterally ($M_{LAT}$) completely independently from one another. This means that each fin can be moved fore-and-aft, side-to-side, and further can be angled so that they are not necessarily aligned parallel with the axis 55 of the surfboard. This functionality has never been provided by previous fin mounting systems, and it has proven to allow the user to truly customize the performance of his or her watercraft like never before.

Figure 7:
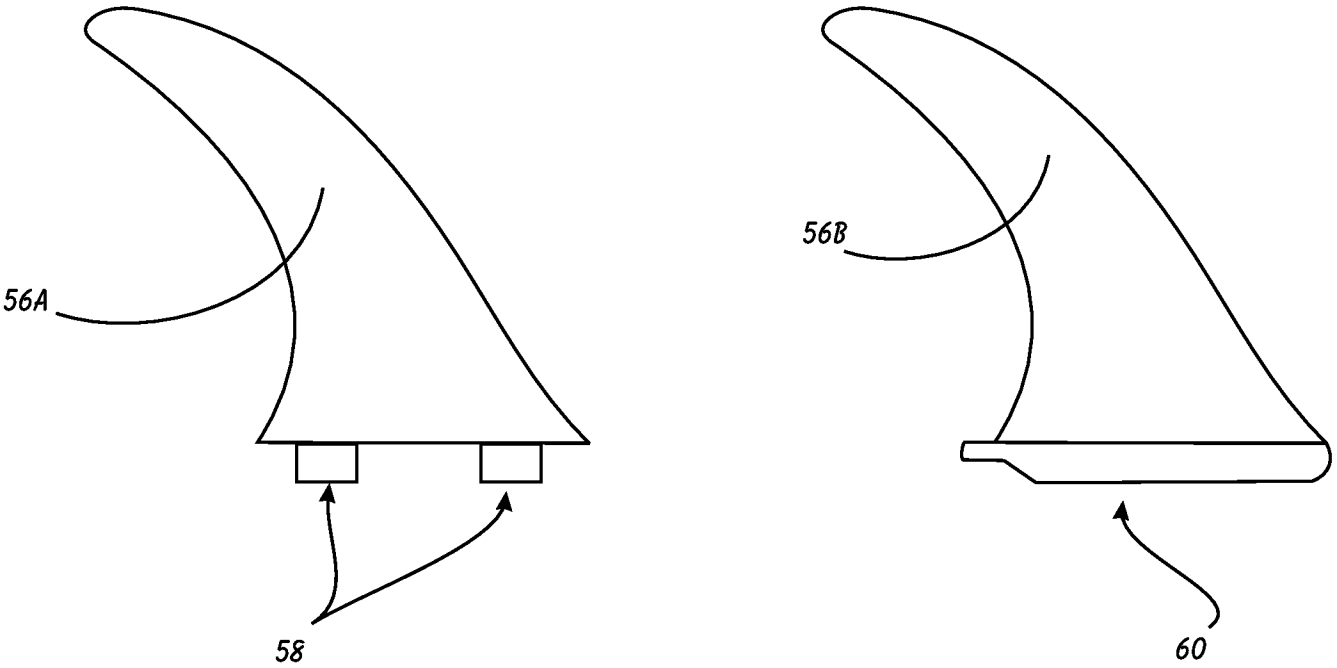
FIG. 7 are a pair of perspective views of exemplary conventional fins that are compatible with the assembly of FIG. 3.

Finally, we will turn to FIG. 7 in order to clarify some of the fin element options that are capable of interfacing with the assemblies 30 discussed herein. Here, we can see a dual peg fin element 56A (having two pins extending downward) and a single peg fin element 56B (having a single pin extending downward). Another recent version of fin element 56 has an elongate rail-shaped pin extending from it. This rail-shaped fin extends along a substantial portion of the bottom face of the fin element 56, presumably to provide maximum structural durability in the fin element 56. The assemblies [30] are designed to allow any of these prior fin element 56 designs to work with them.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A fin mounting assembly for watercraft hulls, comprising:

a housing, comprising:
- perimeter sidewalls;
- a bottom wall; and
- a top wall having a fin aperture formed therethrough and further defining a top wall spacial plane;

a slider plate encased within said housing such that said slider plate can move relative to said housing in two directions along said top wall spacial plane; and a securing fastener protruding through said top wall and extending therethrough to engage said slider plate to prevent said slider plate from moving relative to said housing.

2. The fin mounting assembly of claim 1, wherein wherein:

said housing defines in internal chamber having a length and a width; and said slider plate length is less than said housing internal chamber length and said slider plate width is less than said housing internal chamber width.

3. The fin mounting assembly of claim 2, defined by end gaps between outer ends defined by said slider plate and inner surfaces defined by an opposing pair of said sidewalls, and further defined by side gaps between outer side ends defined by said slider plate and inner surfaces defined by a second opposing pair of said sidewalls.

4. The fin mounting assembly of claim 2 wherein said housing top wall is removable whereby said slider plate is removable.

5. The fin mounting assembly of claim 4, wherein said slider plate comprises a fin pin socket formed therein.

6. The fin mounting assembly of claim 5, wherein said slider plate comprises a pair of fin pin assemblies formed therein.

7. The fin mounting assembly of claim 2, wherein said securing fastener is configured to protrude through said top wall and press said slider plate against said bottom wall, whereafter said slider plate is prevented from moving.

8. The fin mounting assembly of claim 1 wherein said housing top wall is removable whereby said slider plate is removable.

9. The fin mounting assembly of claim 8, defined by end gaps between the outer ends of said slider plate and the inner surfaces of an opposing pair of said sidewalls, and further defined by side gaps between the outer side ends of said slider plate and the inner surfaces of a second opposing pair of said sidewalls.

10. The fin mounting assembly of claim 8, wherein said securing fastener is configured to protrude through said top wall and press said slider plate against said bottom wall, whereafter said slider plate is prevented from moving.

11. The fin mounting assembly of claim 1, wherein said slider plate comprises a fin pin socket formed therein.

12. The fin mounting assembly of claim 11, wherein said slider plate comprises a pair of fin pin assemblies formed therein.

13. The fin mounting assembly of claim 11, wherein said securing fastener is configured to protrude through said top wall and press said slider plate against said bottom wall, whereafter said slider plate is prevented from moving.

14. The fin mounting assembly of claim 1, wherein said securing fastener is configured to protrude through said top wall and press said slider plate against said bottom wall, whereafter said slider plate is prevented from moving.

* * * * *